United States Patent [19]

Zen

[11] 4,416,084

[45] Nov. 22, 1983

[54] PROTECTIVE DEVICE

[76] Inventor: Giuseppe Zen, 3475 Pandora St., Vancouver, British Columbia, Canada, V5K 1W7

[21] Appl. No.: 375,852

[22] Filed: May 7, 1982

[51] Int. Cl.[3] ..... E06B 3/68

[52] U.S. Cl. ..... 49/50; 52/507

[58] Field of Search ..... 49/50, 57, 61, 55; 52/208, 106, 507

[56] References Cited

U.S. PATENT DOCUMENTS

| | | | |
|---|---|---|---|
| 1,346,094 | 7/1920 | Josler | 49/57 |
| 1,730,151 | 10/1929 | Kemp | 52/507 |
| 1,734,415 | 11/1929 | Bierfield | 49/55 X |
| 3,167,828 | 2/1965 | Hutchisson, Jr. | 49/57 |
| 3,224,048 | 12/1965 | Sullivan | 52/507 X |
| 4,000,590 | 1/1977 | Kordewick | 52/106 |

FOREIGN PATENT DOCUMENTS

| | | | |
|---|---|---|---|
| 54-121541 | 9/1979 | Japan | 49/50 |

*Primary Examiner*—Philip C. Kannan

*Attorney, Agent, or Firm*—Townsend and Townsend

[57] ABSTRACT

A protective device for a building adapted to be installed at a window to prevent ingress, the device comprising a first member adapted to be attached to one edge of the window; a second member adapted to be mounted to a further edge of the window, opposed to the first channel member; each member including recesses formed in it at predetermined centers; and a bar extending between a pair of opposed recesses to prevent ingress, the bars being located by the attachment of the members to the window surround.

5 Claims, 3 Drawing Figures

Fig. 1.
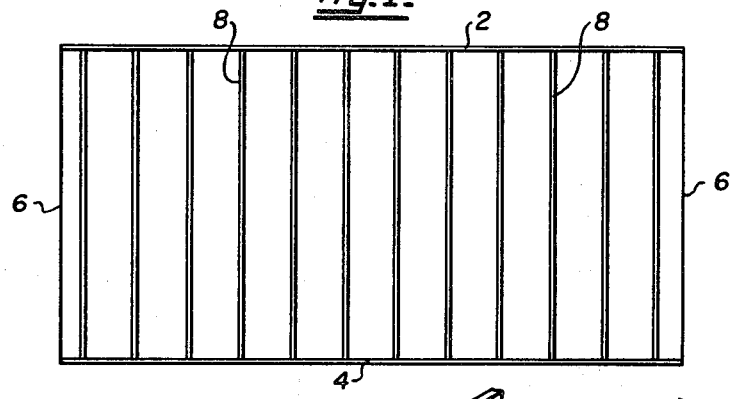
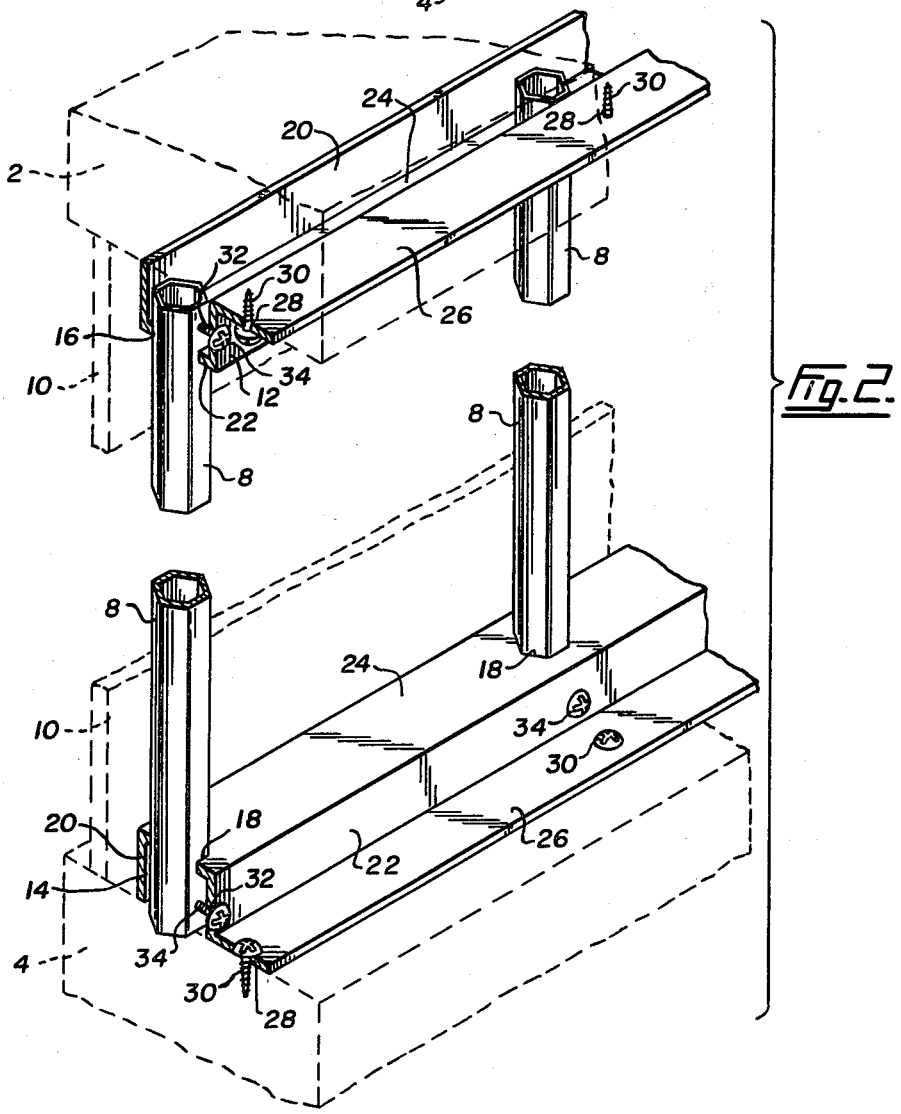
Fig. 2.

PROTECTIVE DEVICE

FIELD OF THE INVENTION

This invention relates to a protective device for a building. The device is to be installed inside a window so that, for example, illegal entry is prevented.

DESCRIPTION OF THE PRIOR ART

Devices for preventing illegal entry into a building are well known. Typically they comprise bars placed across the window and spaced in such a way that a human cannot pass between them. However, the prior systems of protecting windows in this way have proved difficult. Typically, they comprise a frame made to fit a particular window and having bars welded to and extending between members positioned at the sides or at the top and bottom of the window. The production of such a unit is expensive in that each window must be treated individually and small errors may necessitate scrapping one item produced and starting all over again.

SUMMARY OF THE INVENTION

The present invention seeks to produce a protective device that is extremely simple to install and, in particular, can be installed by the homeowner by himself. Indeed, in a preferred embodiment the invention provides a kit of parts to be used by the homeowner to install protective devices on his windows.

Accordingly, in a first aspect, the present invention is a protective device for a building adapted to be installed at, preferably inside a window to prevent ingress, the device comprising; a first member adapted to be attached to one edge of the window; a second member adapted to be mounted on a further edge of the window, opposed to the first member; each member including recesses formed in it at predetermined centers; a bar extending between a pair of opposed recesses to prevent ingress, the bars being located by the attachment of the members to the window surround.

The first and second members may conveniently be formed as channel sections.

In a further aspect the invention is a protective kit of parts for a protective device to be installed at a building window to prevent ingress through the window, the kit comprising a first member of a length so that it can be cut to a length to fit at one edge of the window; a second member of a length that can be cut to a length to be mounted at a further edge of the window, opposed to the first member; recesses formed in the members at predetermined centers; a plurality of bars in the kit to be positioned so that each bar extends between a pair of opposed recesses to prevent ingress.

BRIEF DESCRIPTION OF THE DRAWINGS

Aspects of the invention are illustrated, by way of example, in the drawings, in which:

FIG. 1 is a window protector according to the present invention;

FIG. 2 is a detail of FIG. 1; and

DESCRIPTION OF THE PREFERRED EMBODIMENTS

Figure 3:
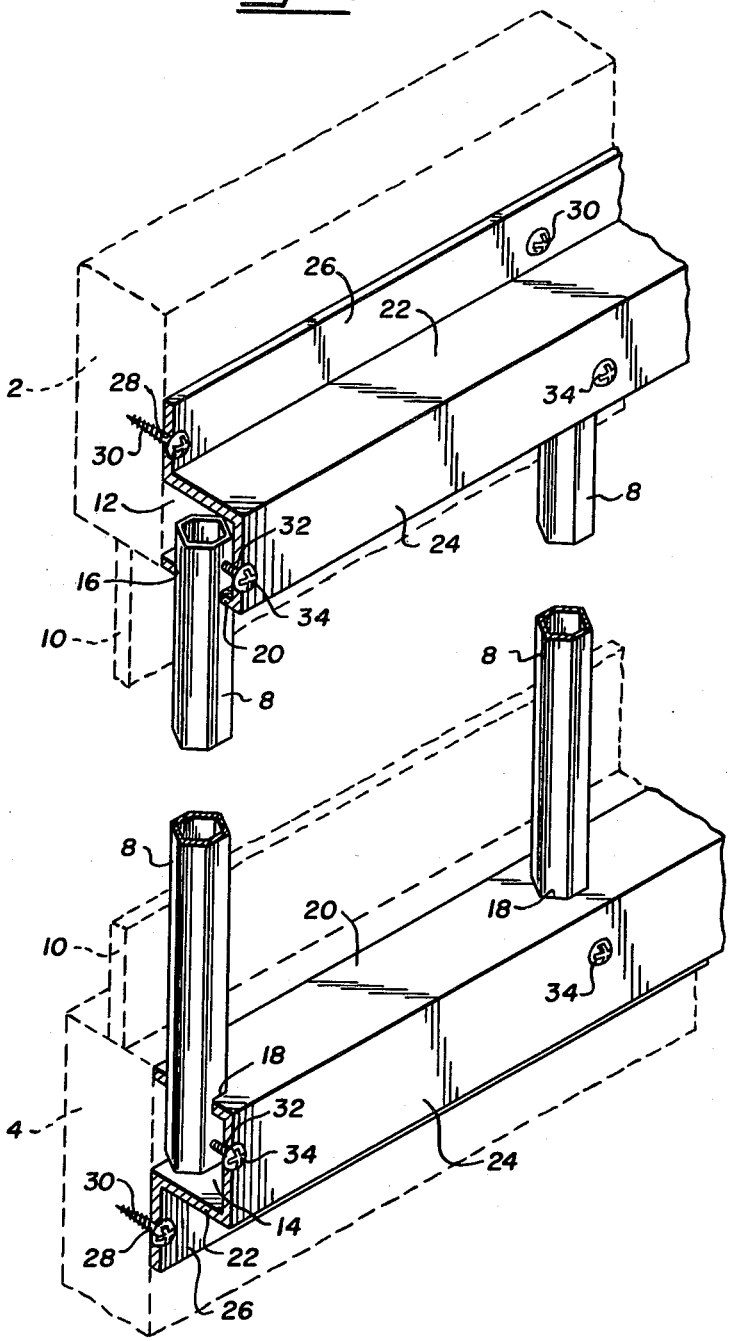
FIG. 3 illustrates a further embodiment.

FIG. 1 illustrates a window having a top edge 2 and a bottom edge 4 and side edges 6. There are protector bars 8 extending across the window. FIG. 2 illustrates the installation of those bars according to one aspect of the present invention behind a window pane 10. FIG. 2 illustrates a first channel 12 attached to the top edge 2 of the window and a second channel 14 attached to the bottom edge 4 of the window, opposed to the first channel 12. The channel members 12 and 14 have recesses 16 and 18 respectively formed at predetermined centers and the bars 8 extends between these recesses 16 and 18, between opposed pairs, at centers close enough to prevent ingress. The channel members are generally U-shaped, the U having limbs 20 and 22 joined by a bridge 24. There is a flange 26 extending from one limb 22 of the U, remote from the bridge 24 and holes 28 are formed in the flange 26. Screws 30 extend through these holes 28 to engage in the window ledge or in the upper edge of the window. The recesses 16 and 18 are formed in the bridges 24 of the U. In the illustrated embodiment of FIG. 2 there are holes 32 extending through limb 22 of the U and these holes 32 may be threaded so that screws 34 inserted into them abut the bars 8 to locate them. Alternatively, a threaded hole may be provided in the bars 8 and the hole 32 in the channel member is then clear.

FIG. 3 shows a modification in which the recesses 16 and 18 are positioned in a limb of the U and may be used if the window shape, for example, prevents use of the FIG. 2 embodiment.

The present invention is particularly applicable for sale as a kit at a hardware store to be installed by the owner of a private house. To install the protective device of the invention first the window is measured and a length of channel member in the kit then cut to the required length. A second length of channel member is cut and both channel members are then desirably placed over the bars and the pieces, the upper and the lower channel members and the bars extending between them, then inserted in the window. Simple screwing in of the screws 30 through the holes 28 in the flange 26 then secures the bars in position as in FIG. 1 to protect the window. If necessary, screws 34 may be inserted to locate the bars in position. With a kit sold like this all the recesses 16 and 18 need not be used to receive a bar 8. For example, it may be sufficient to attach a bar 8 in every other recess 16 and 18 in the channel members.

Similarly, there is no restriction as to where the channel members are to be mounted. This can be placed at the side edges 6 of the window.

In the FIG. 3 embodiment the recesses need not be formed in the bridge of the U but may be formed in the limb 20 of the U, remote from the flange 26. The device is then installed with the recesses facing towards each other as in FIG. 2.

The protector bars and the channel may be made of aluminum which provides a noncorroding and thus more attractive appearance for a private house. However, it is equally appropriate to make the components of steel.

The device may be mounted outside a window although inside is preferred. If outside then it is preferred to remove or hide the heads of the screws 30. The channel members shown may be replaced by solid bars with recesses formed in them or, indeed, any other shape. The bars 8 need not be vertical but may extend across the window, they may be solid and their cross section is unimportant. Screws 34 are not essential. The bars 8 may simply rest in the recesses.

I claim:

1. A protective device for a building adapted to be installed at a window to prevent ingress, the device comprising:

a first member adapted to be attached to one edge of the window;

a second member adapted to be mounted to a further edge of the window, opposed to the first member;

each member being a channel member of generally U-shape, the U having limbs joined by a bridge, with a flange extending from one limb of the U, remote from the bridge;

holes to receive screws formed in the flange; recesses formed in the bridge of the U at predetermined centers;

a bar extending between a pair of opposed recesses to prevent ingress, holes extending through a limb of the U adjacent the flange to permit locating means to extend into the channel member to locate the bars, the bars also being located by the attachment of the members to the window edges.

2. A protective device for a building adapted to be installed at a window to prevent ingress, the device comprising:

a first member adapted to be attached to one edge of the window;

a second member adapted to be attached to a further edge of the window, opposed to the first member;

each member being a channel member of generally U-shape, the U having limbs joined by a bridge, with a flange extending from a limb of the U, remote from the bridge;

recesses formed in each member at predetermined centers in one limb of the U;

a bar extending between a pair of opposed recesses to prevent ingress, holes extending through the bridge of the U to permit locating means to extend into the channel member to locate the bars, the bars also being located by the attachment of the members to the window edges.

3. A kit of parts for a protective device to be installed at a building window to prevent ingress through the window, the kit comprising a channel member of generally U-shape, the U having limbs formed by a bridge with a flange extending from a limb of the U, remote from the bridge, the channel member being of a length so that it can be cut to lengths to fit at both edges of the window;

recesses formed in the channel member in the bridge of the U at predetermined centers;

at least one bar length in the kit that can be cut to provide a plurality of bars, each bar to be positioned to extend between a pair of opposed recesses to prevent ingress at the building window;

holes in the channel member extending through a limb of the U, adjacent the flange to permit locating means to extend into the channel member to locate the bars.

4. A kit as claimed in claim 3 including the necessary screws to mount the device at a window.

5. A kit of parts for a protective device to be installed at a building window to prevent ingress through the window, the kit comprising a channel member of a generally U-shape, the U having limbs joined by a bridge, with a flange extending from a limb of the U, remote from the bridge, the channel member being of a length so that it can be cut to a length to fit at both edges of the window;

recesses formed in the channel member in one limb of the U, remote from the flange;

holes to receive screws formed in the flange;

at least one bar length in the kit that can be cut to provide a plurality of bars, each bar to be positioned to extend between a pair of opposed recesses to prevent ingress;

holes in the channel member extending through the bridge of the U, adjacent the flange, to permit locating means to extend into the channel member to locate the bars.

* * * * *